US009229370B2

(12) United States Patent
Salomons et al.

(10) Patent No.: US 9,229,370 B2
(45) Date of Patent: Jan. 5, 2016

(54) TONER BOTTLE CAP AND REFILL MECHANISM

(71) Applicant: OCE-TECHNOLOGIES B.V., Venlo (NL)

(72) Inventors: Otto W. Salomons, Venray (NL); Joseph A. Schulkes, Asten (NL)

(73) Assignee: Oce-Technologies B.V., Venlo (NL)

( * ) Notice: Subject to any disclaimer, the term of this patent is extended or adjusted under 35 U.S.C. 154(b) by 4 days.

(21) Appl. No.: 14/256,824

(22) Filed: Apr. 18, 2014

(65) Prior Publication Data

US 2014/0255058 A1 Sep. 11, 2014

Related U.S. Application Data

(63) Continuation of application No. PCT/EP2012/069695, filed on Oct. 5, 2012.

(30) Foreign Application Priority Data

Oct. 19, 2011 (EP) ..... 11185719

(51) Int. Cl.
*G03G 15/00* (2006.01)
*G03G 15/08* (2006.01)

(52) U.S. Cl.
CPC ..... *G03G 15/0881* (2013.01); *G03G 15/0855* (2013.01); *G03G 15/0865* (2013.01); *G03G 15/0867* (2013.01); *G03G 15/0877* (2013.01); *G03G 15/0886* (2013.01); *G03G 15/0894* (2013.01); *G03G 2215/0692* (2013.01)

(58) Field of Classification Search
CPC ..... G03G 15/0886; G03G 15/0872; G03G 15/0865; G03G 15/0867; G03G 15/0877; G03G 15/0881; G03G 2215/0668; G03G 2215/0692; G03G 2215/067
USPC ..... 399/102, 103, 106, 120
See application file for complete search history.

(56) References Cited

U.S. PATENT DOCUMENTS 5,481,344 A 1/1996 Yasuda et al.
6,785,497 B1 * 8/2004 Hasebe ..... 399/260

(Continued)

FOREIGN PATENT DOCUMENTS

EP 1 233 310 A2 8/2002

OTHER PUBLICATIONS

Form PCT/ISA/237 (Jul. 2009); Written Opinion of the International Searching Authority.

*Primary Examiner* — Walter L Lindsay, Jr.
*Assistant Examiner* — Jessica L Eley
(74) *Attorney, Agent, or Firm* — Birch, Stewart, Kolasch & Birch, LLP

(57) ABSTRACT

A toner bottle cap has a fixed member and a slide member. The fixed member is stationary relative to a toner bottle and defines a first flow passage. The slide member defines a second flow passage coaxially adjoining the first flow passage in a toner outflow direction and having a peripheral wall in sealing contact with a peripheral wall of the fixed member. The slide member is slideable relative to the fixed member in axial direction of the flow passages. One of the members has a wall part that restricts the cross-section of the flow passage of the one member and defines a toner outflow opening. The other of the members has a stop member projecting axially towards the outflow opening and closes the same when the slide member is in a closed position and opens the outflow opening when the slide member is slid in the toner outflow direction.

11 Claims, 4 Drawing Sheets

(56) References Cited

U.S. PATENT DOCUMENTS

2005/0147428 A1* 7/2005 Yamada ..... G03G 15/0896 399/106
2006/0104660 A1 5/2006 Doi et al.
2007/0025774 A1* 2/2007 Leute ..... 399/258
2009/0232548 A1* 9/2009 d'Entrecasteaux ..... 399/120
2010/0303508 A1 12/2010 Tamura

* cited by examiner

TONER BOTTLE CAP AND REFILL MECHANISM

CROSS-REFERENCE TO RELATED APPLICATIONS

This application is a Continuation of International Application No. PCT/EP2012/069695, filed on Oct. 5, 2012, and for which priority is claimed under 35 U.S.C. §120. PCT/EP2012/069695 claims priority under 35 U.S.C. §119(a) to Application No. 11185719.9, filed in Europe on Oct. 19, 2011. The entire contents of each of the above-identified applications are hereby incorporated by reference into the present application.

BACKGROUND OF THE INVENTION

1. Field of the Invention

The present invention relates to a toner bottle cap having a fixed member and a slide member, wherein the fixed member is stationary relative to a toner bottle and defines a first flow passage for the toner, the slide member defines a second flow passage coaxially adjoining the first flow passage in a toner outflow direction and having a peripheral wall in sealing contact with a peripheral wall of the fixed member, the slide member being slideable relative to the fixed member in axial direction of the first and second flow passages.

The present invention further relates to a toner refill mechanism comprising such a toner bottle cap.

2. Description of Background Art

When a toner reservoir of a printer or copier has to be refilled with toner from a toner bottle, a refill mechanism is needed that permits to establish a flow communication between the interior of the toner bottle and the toner reservoir without allowing the fine toner powder to escape. Further, it should be avoided that toner powder remains on the external surfaces of closure members of the toner reservoir and the toner bottle when the refill process has been completed. In addition, it is advantageous to prevent the creation of toner chips which, when they fall into the toner reservoir, may disturb the toner development process in the printer or copier. Such toner chips are likely to be formed when toner powder adheres to walls of the refill mechanism which may come into sliding engagement with one another so that frictional heat causes the toner powder to cake.

U.S. Pat. No. 5,481,344 discloses a toner bottle cap of the type indicated above, wherein toner outflow openings are formed in a peripheral wall of the slide member. In the closed position of the slide member, these outflow openings are closed by the surrounding peripheral wall of the fixed member. When the slide member is axially slid into the open position, the outflow openings reach a position axially offset from the fixed member, so that the toner may flow out.

In this known mechanism, however, toner chips may still be formed when toner adheres to the wall portions of the fixed member that close the outflow openings.

SUMMARY OF THE INVENTION

It is an object of the present invention to provide a toner bottle cap and a toner refill mechanism that can prevent the formation of toner chips more reliably.

To that end, according to the present invention, the toner bottle cap includes one of the fixed member and the slide member having a wall part that restricts the cross-section of the flow passage of the one member and defines a toner outflow opening, and the other of fixed member and the slide member has a stop member that projects axially towards the outflow opening and closes the outflow opening when the slide member is in a closed position and opens the outflow opening when the slide member is slid in the toner outflow direction.

When the slide member is moved in the outflow direction, none of the wall portions that have been in contact with the toner powder will come into sliding engagement with any other wall. Therefore, no toner will be exposed to frictional heat. Moreover, as long as the outflow opening is closed by the stop member, the inner periphery of the outflow opening is not in contact with toner powder, and when the slide member is moved to the open position, the stop member moves axially away from the outflow opening, without frictional engagement with any part that has been in contact with toner powder.

The toner bottle cap according to the present invention has the further advantage that it has a simple construction and may be formed of only two separate parts, i.e. the fixed member and the slide member, which can easily be fitted together. Moreover, the entire toner bottle cap may be made of one and the same material, which simplifies material recycling and removes the necessity to disassemble the toner bottle cap in order to separate different materials from one another.

In one embodiment according to the present invention, the outflow opening is formed in a bottom wall of the slide member, and the stop member is held in the center of the first flow passage by radial arms.

In an alternative embodiment, the outflow opening may be formed in a bottom wall of the fixed member, and the stop member may be disposed in the center of the second flow passage and held by radial arms so as to project upwardly towards the fixed member.

The toner refill mechanism may further comprise an adapter that defines a closable toner refill opening of a toner reservoir of a copier or printer, the adapter and the toner bottle cap being arranged to be coupled to one another.

Preferably, the refill mechanism comprises a coupling mechanism that interconnects the slide member of the toner bottle cap and a closure member for the toner refill opening in the adapter such that the movement of the slide member between its open and closed positions is coupled to the movement of the closure member between its open and closed positions.

Preferably, the coupling is such that, when the toner bottle cap is to be detached from the adapter, the slide member is not moved towards its closed position before the toner refill opening in the adapter has been closed by the closing member. This prevents any possible toner chips that might be produced during the closure movement of the slide member from falling into the toner reservoir.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
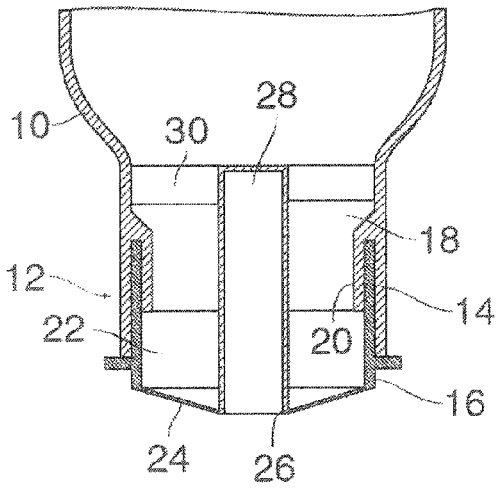
FIG. 1 is a sectional view of a toner bottle cap according to a first embodiment of the present invention in the closed state.

The present invention will now be described with reference to the accompanying drawings, wherein the same or similar elements are identified with the same reference numerals throughout the several views.

In FIG. 1, a neck portion of a toner bottle 10 has been shown in an inverted state with the neck portion facing downward (it will be understood that the term "toner bottle," as used here, designates any type of vessel that is capable of accommodating powdery or liquid toner). The toner bottle 10 is closed by a cap 12 that is composed of a fixed member 14 and a slide member 16. The fixed member is fixed at the neck portion of the bottle 10 and is configured as a tubular body defining a first flow passage 18 for toner powder that is contained in the bottle 10. The slide member 16 is configured as a tubular sleeve having a peripheral wall that is in sliding engagement with the internal surface of the peripheral wall of the fixed member 14. In the example shown, the fixed member 14 is internally formed with a skirt 20 that is in sliding engagement with the internal surface of the peripheral wall of the slide member 16.

The slide member 16 defines a second flow passage 22 for the toner powder. The first and second flow passages 18, 22 are coaxially aligned and connected to one another so that the toner powder from the bottle 10 may flow through in an outflow direction from the fixed member to the slide member.

At its bottom end, the slide member 16 has a funnel-shaped wall part 24 that restricts the cross-section of the second flow passage 22 and defines a narrower outflow opening 26 for the toner powder. In the condition shown in FIG. 1, however, the outflow opening 26 is closed by a cylindrical stop member 28 that is disposed centrally in the flow passages 18, 22 and is held in position by radial arms 30, which connect the top end of the stop member 28 to the peripheral wall of the fixed member 14. The radial arms 30 divide the first flow passage 18 into a plurality of sector-shaped openings through which the toner powder may pass through.

In the condition shown in FIG. 1, the bottom end of the stop member 28 is flush with the outflow opening 26 and is exactly fitted in the outflow opening, so that no toner powder may enter into the outflow opening 26.

In a modified embodiment, the end of the stop member may rest on the top surface of the wall part 24 on the entire periphery of the outflow opening 26 rather than plunging into the outflow opening.

Figure 2:
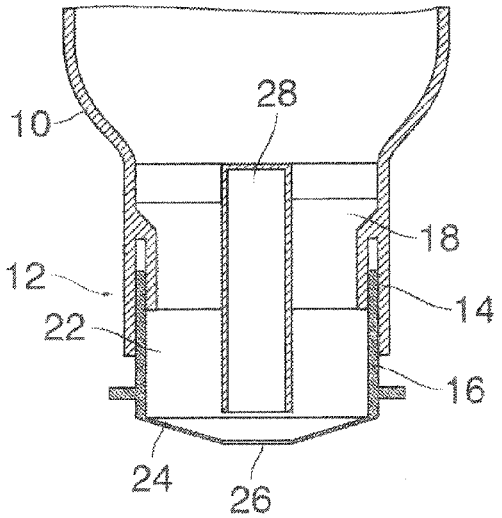
FIG. 2 illustrates the toner bottle cap of FIG. 1 in the open state.

In order to open the toner bottle cap 12, the slide member 16 is slid downwardly relative to the fixed member 18 as has been shown in FIG. 2. As a result, the stationary stop member 28 is withdrawn from the outflow opening 26, so that the toner powder may flow out.

During the downward movement of the slide member 16, the peripheral wall thereof slides along the internal surface of the outer peripheral wall of the fixed member 14. However, the internal surface of the peripheral wall of the fixed member 14 has always been covered by the peripheral wall of the slide member 16 and/or by the skirt 20, so that no toner powder can adhere to that wall. Toner powder may adhere only to the internal surface of the lower part of the peripheral wall of the slide member 16, which is not covered by the skirt 20. During the opening movement of the slide member 16, this member moves downward, i.e. in the outflow direction of the toner powder, so that an increasingly larger portion of the internal surface of the peripheral wall becomes exposed to the toner powder. However, as long as the slide movement of the slide member 16 is not reversed, none of these surface areas of the slide member will come into sliding engagement with a part of the fixed member again. As a result, the toner powder may smoothly flow out without being exposed to frictional heat that could cause the fine toner powder to cake and to form larger solid chips. Thus, when the toner bottle with the cap 12 is placed on top of a toner refill opening of a toner reservoir of a copier or printer, the toner powder exiting from the outflow opening 26 will not contain any chips that could deteriorate the developing properties of the toner.

When the slide member 16 is moved upwards again in order to close the toner bottle, remnants of toner powder that stick to the internal wall of the slide member 16 may be stripped-off by the skirt 20 and may fall down towards the conical wall part 24. However, since the inclination of this wall part is relatively small, the toner powder stripped off from the peripheral wall (and any chips that may possibly be formed) will not reach the outflow opening 26 before this opening is closed again by the stop member 28.

It will further be noted that the wall part 24 is relatively thin, so that the edge surface of the outflow opening 26 has only a very small surface area to which only very minute amounts of toner powder may adhere. Consequently, the amount of toner powder that my leak from the bottle 10 when this bottle is closed again is extremely small.

Similarly, the stop member 28 is configured as a thin-walled hollow cylinder (closed at the top end), so that practically no toner power will adhere to the bottom end of the stop member 28.

Figure 3:
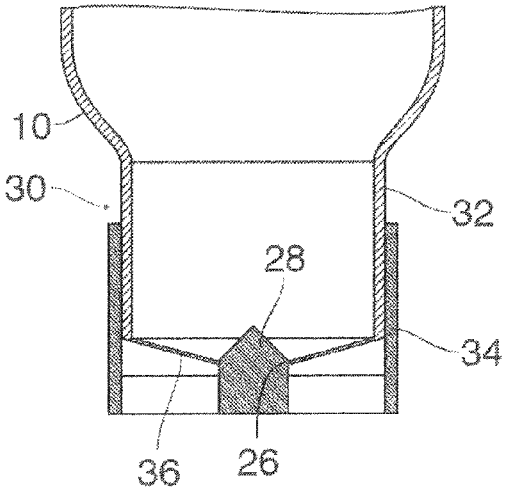
FIG. 3 is a sectional view of a toner bottle cap according to another embodiment of the present invention in the closed state.
Figure 4:
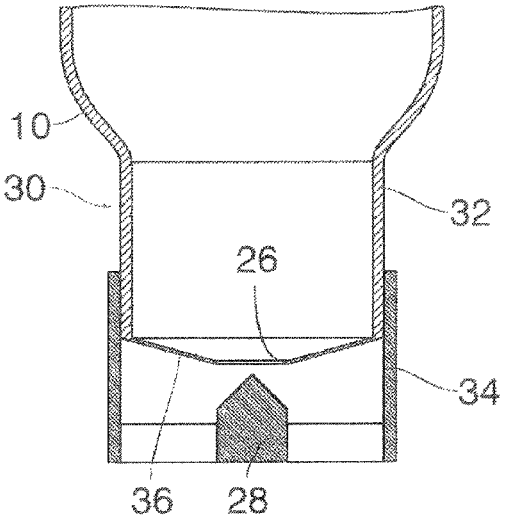
FIG. 4 illustrates the toner bottle cap of FIG. 3 in the open state.

As another example, FIG. 3 shows a toner bottle cap 30 composed of a fixed member 32 and a slide member 34, wherein the slide member 34 is in sliding engagement with the external surface of the peripheral wall of the fixed member 32. In this case, the outflow opening 26 is defined in a funnel-shaped bottom wall part 36 of the fixed member 32, and the stop member 28 is held in the center of the bottom end of the slide member 34 so as to project upwardly into the outflow opening 26. The top member has a conical shape so that, in the open condition, shown in FIG. 4, the toner powder may flow out smoothly.

In this embodiment, the wall part 36 shields the internal surface of the peripheral wall of the slide member 34, thereby reducing the likelihood that this surface becomes stained with toner powder.

Figure 5:
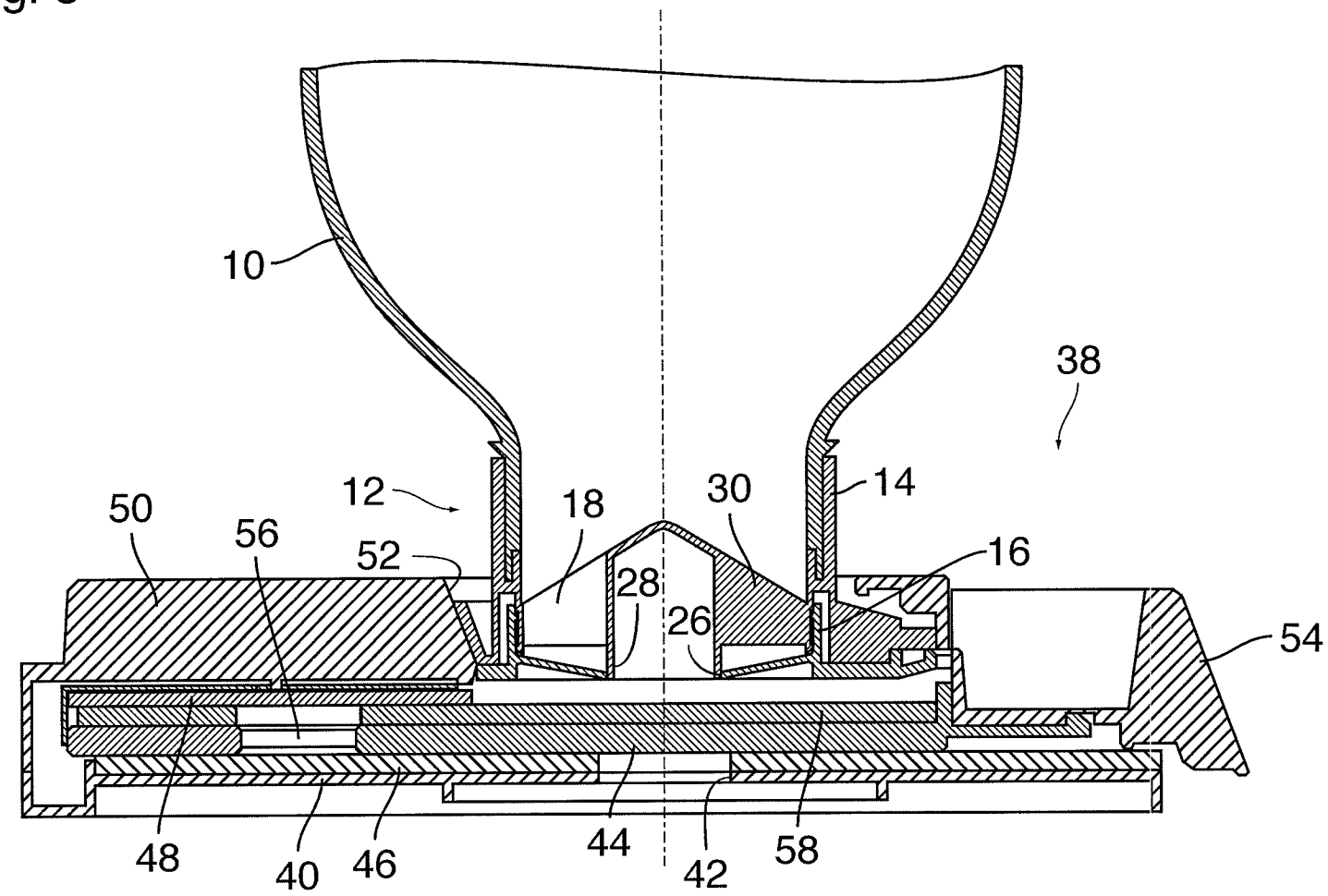
FIGS. 5 to 7 are sectional views of a refill mechanism including a toner bottle cap and a toner refill adapter.

FIG. 5 shows a practical embodiment of a complete toner refill mechanism comprising the toner bottle cap 12 with the general construction shown in FIGS. 1 and 2 in combination with a toner refill adapter 38 of a toner reservoir (not shown) of a copier or printer.

The adapter 38 has a base plate 40 that is tightly attached to the toner reservoir and defines a refill opening 42 of that toner reservoir. In the condition shown in FIG. 5, the refill opening 42 is closed by a plate-like closure member 44 that is slidably sandwiched between low-friction seal plates 46 and 48.

A socket plate 50 is disposed above the seal plate 48 and is rigidly connected to the base plate 40. The socket plate 50 defines a socket 52 that is adapted to be engaged by the lower part of the toner bottle cap 12, so that the toner bottle 10 with the toner bottle cap 12 attached thereto may be coupled to the adapter 38.

A drawer 54 is slidably disposed in a casing that is formed by the base plate 40 and the socket plate 50. The drawer 54 may be drawn-out to the right side in FIG. 5 and is mechanically coupled to the closure member 44, so that, when the drawer 54 is drawn out, the closure member 44 is slid into a position such that a through-opening 56 thereof becomes flush with the refill opening 42, so that toner may be filled-in. The drawer 54 is further coupled to the slide member 16 of the toner bottle cap 12 in such a manner that the pull-out movement of the drawer 54 also induces a downward movement of the slide member 16 relative to the fixed member 14.

In the condition shown in FIG. 5, the outflow opening 26 of the toner bottle cap 12 is blocked by the stop member 28, so that no toner may flow out. While the fixed member 14 is held stationary in the socket 52, the slide member 16 is guided for vertical movement in the socket 52. The lower part of the slide member 16 forms a gap with a seal plate 58 that is disposed on top of the closure member 44.

Figure 6:
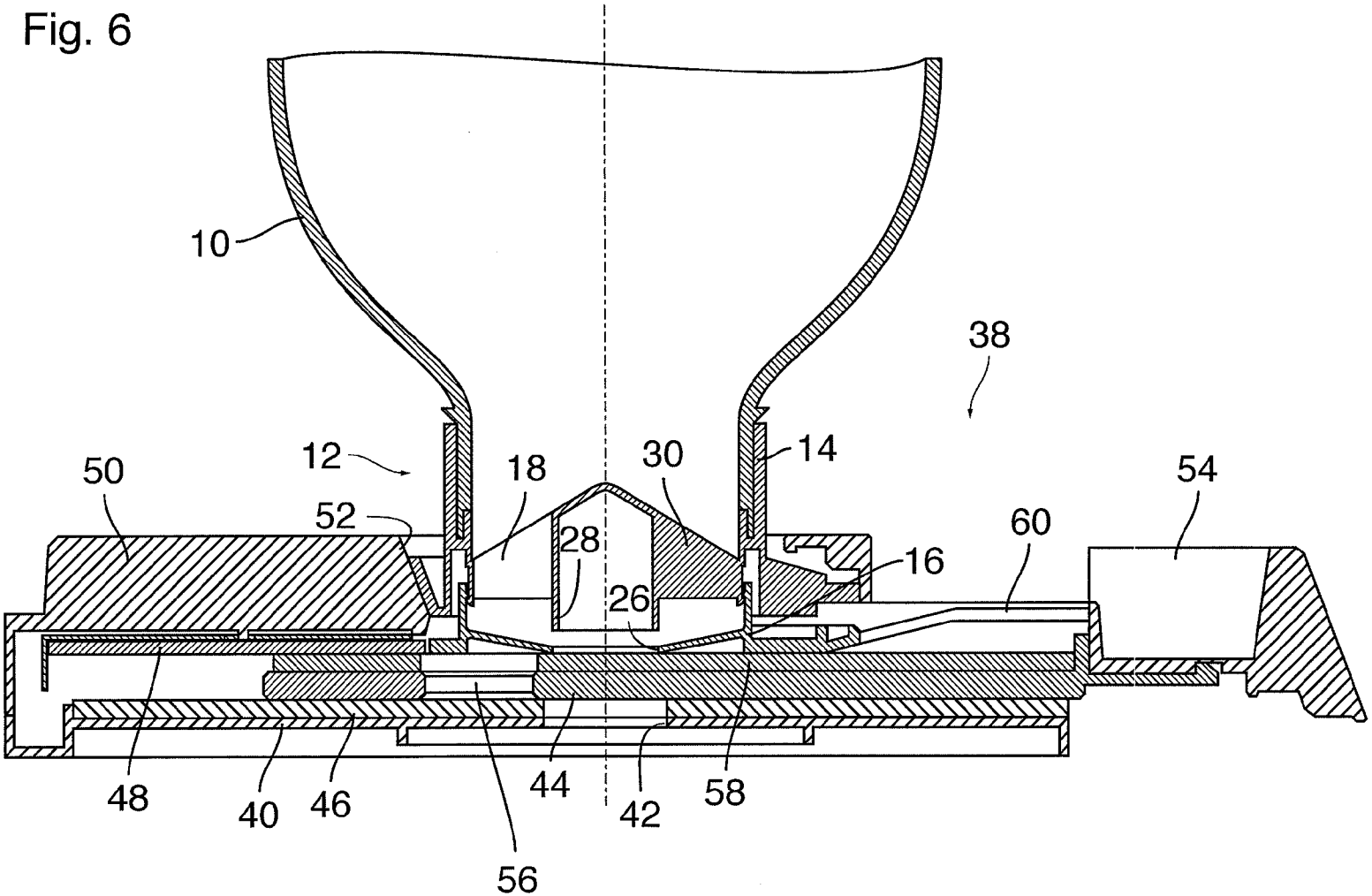

When the drawer 54 is pulled out, as has been shown in FIG. 6, the slide member 16 is lowered until its bottom surface rests on the seal plate 58. Thus, the outflow opening 26 is no longer blocked by the stop member 28, but is now closed by the seal plate 58, so that the toner still does not flow out.

As can further been seen in FIG. 6, the drawer 54 is formed with guide grooves 60, which are engaged by cams (not shown) that project outwardly from the bottom part of the slide member 16. In this way, the horizontal pull-out movement of the drawer 54 is translated into the vertical slide movement of the slide member 16.

Figure 7:
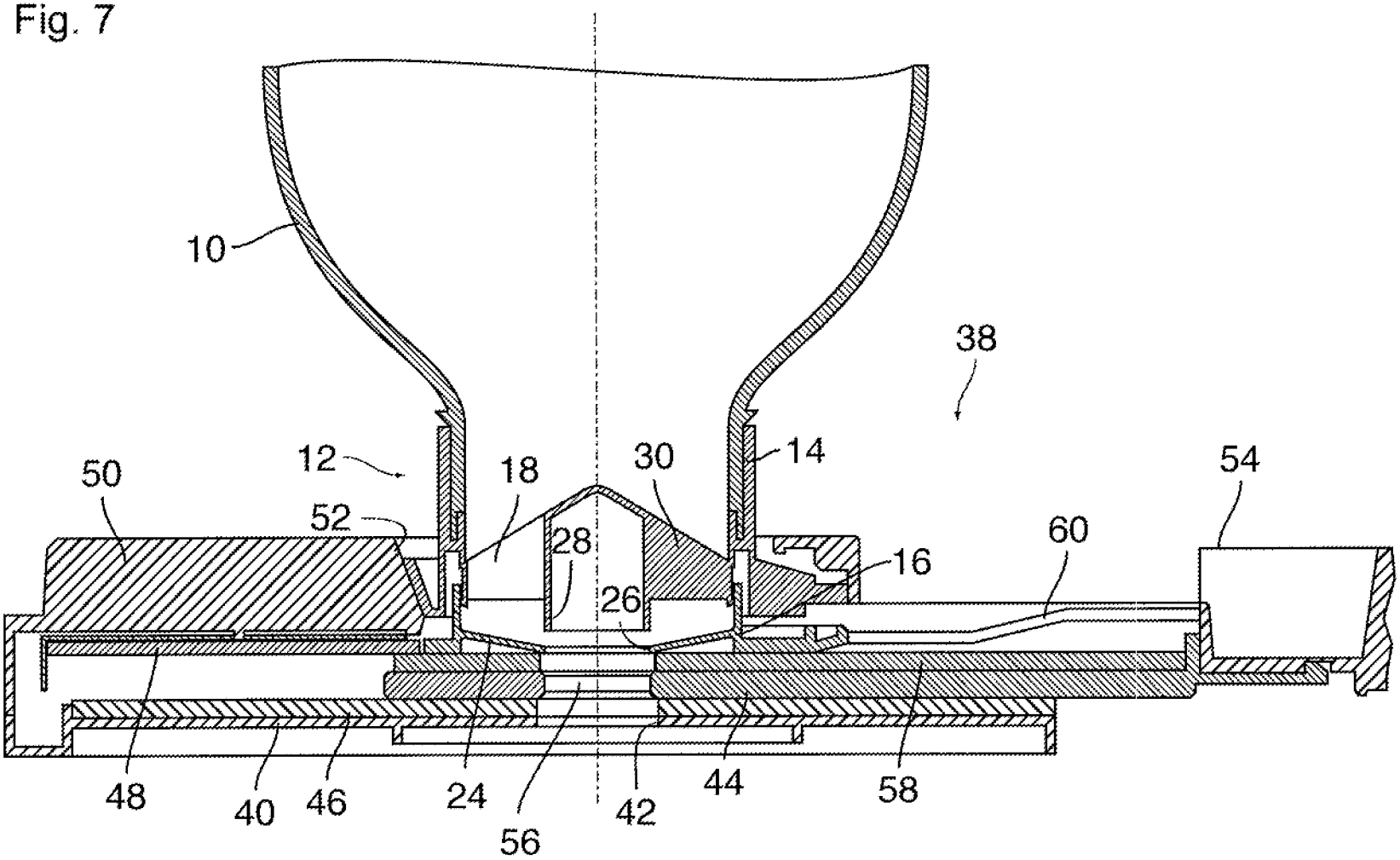

When the pull-out movement of the drawer 54 is continued, the through-opening 56 of the closure member 44 (and of the seal plate 58) reaches the position coinciding with the position of the refill opening 42 and the outflow opening 26, as is shown in FIG. 7. Thus, only a very short instant after the stop member 28 has cleared the outflow opening 26, the refill opening 42 is opened, so that toner powder from the bottle 10 may pass through the flow passages 18, 22, the outflow opening 26, the through opening 56 and the refill opening 42 into the toner reservoir.

The conical bottom wall part 24 has a certain elasticity, so that it is slightly pressed against the top surface of the seal plate 58. Further, the peripheral edge of the outflow opening 26 is configured as a sharp, downwardly projecting knife-edge forming only a very small contact area with the seal plate 58. The seal plate 58 is made of a material that does not tend to attract the toner powder. All of these measures assure that any toner powder that has dropped onto the surface of the seal plate 58 before the position shown in FIG. 7 has been reached will be pushed into the through opening 56 and the refill opening 42 without being subject to substantial friction on the surface of the seal plate 58. In this way, the formation of toner chips can reliably be prevented.

It should be observed here that the seal plate 58 may be made of a relatively expensive material because it resides permanently in the adapter 38, whereas the toner bottle cap 12 as well as the toner bottle 10 are disposable one-way parts for which only inexpensive materials should be used. It is therefore an advantage of the present invention that the formation of chips in the toner bottle cap 12 can be prevented even when the toner bottle cap is made of a relatively cheap material such as plastics like, e.g. HDPE, PP or the like.

When the refill process has been completed, the drawer 54 is pushed back towards the left side in FIG. 7 so that, first, the refill opening 42 is closed. Then, when it is no longer possible for toner to drop into the toner reservoir, the slide member 16 is lifted to close the toner bottle 10. Thus, even when toner chips could be formed during the upward movement of the slide member 16, they will not enter into the toner reservoir.

Finally, the toner bottle with the toner bottle cap 12 may be detached from the socket plate 50 and disposed of.

It is clear that, as long as the toner bottle 10 with the cap 12 is not coupled to the socket 52, the slide member 16 should be prevented from sliding into the open position. This may, for example, be achieved by elastically biasing the slide member 16 into the closed position. As an alternative, the fixed member 14 may form an elastic locking pin (not shown) that engages a locking recess in the slide member 16, so as to lock the slide member 16 in the closed position. In this case, the drawer 54 may comprise a deflection member that deflects the locking pin into a position in which it no longer engages the locking recess of the slide member 16. Then, when the drawer 54 is pulled out from the position shown in FIG. 5, the deflection member will first unlock the slide member 16, which may then be descended by the action of the guide grooves 60 when the movement of the drawer 54 continues.

In the embodiment that has been described here, the slide member 16 is lowered in order to open the outflow opening 26. Of course, a modified embodiment is also possible wherein, rather than descending the slide member 16, the drawer 54 controls a lift movement of the fixed member 14 and the bottle 10. In this case, when the toner bottle cap 12 is coupled to the socket 52, the slide member 16, in its closed position, will already engage the top surface of the seal plate 58. Then, when the bottle 10 and the fixed member 12 are lifted and the stop member 28 clears the outflow opening 26, the toner powder is prevented from entering into a gap between the wall part 24 of the slide member 16 and the top surface of the seal plate 58.

By providing an appropriate pattern of guide grooves 60 and deflection members, it may even be possible to control the movement of the slide member 16 such that, when the drawer 54 is pulled out, the outflow opening 26 and the reflow opening 42 are opened almost simultaneously by the stop member 28 and the closure member 44, respectively, and, when the drawer 54 is pushed in, the slide member 16 follows a different path such that the refill opening 42 is first closed by the closure member 44, whereas the movement of the slide member 16 into the closed position relative to the fixed member 14 is delayed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner bottle cap:

a fixed member, the fixed member being stationary relative to a toner bottle and defining a first flow passage for toner; and a slide member, the slide member defining a second flow passage coaxially adjoining the first flow passage in a toner outflow direction and having a peripheral wall in sealing contact with a peripheral wall of the fixed member, the slide member being slideable relative to the fixed member in axial direction of the first and second flow passages, wherein one of the fixed member and the slide member has a wall part that restricts the cross-section of the flow passage of said one member and defines a toner outflow opening, and the other of the fixed member and the slide member has a stop member that projects axially towards the outflow opening and closes the outflow opening when the slide member is in a closed position and opens the outflow opening when the slide member is slid in the toner outflow direction.

2. The toner bottle cap according to claim 1, wherein the wall part defining the outflow opening is formed at the slide member.

3. The toner bottle cap according to claim 2, wherein the stop member is configured as a hollow cylinder.

4. A toner refill mechanism comprising:

the toner bottle cap according to claim 1; and a refill adapter that defines a refill opening of a toner reservoir to be refilled, wherein the refill adapter and the toner bottle cap are configured to be coupled to one another.

5. The toner refill mechanism according to claim 4, further comprising:

a closure member for opening and closing the refill opening; and a mechanism coupling the movement of the slide member to the movement of the closure member.

6. The refill mechanism according to claim 5, wherein said coupling mechanism comprises a drawer disposed slidably in the refill adapter and adapted to entrain the closure member to perform a slide movement in a direction normal to an axis of the refill opening and adapted to control a slide movement of the slide member in a direction in parallel with the axis of the refill opening.

7. The refill mechanism according to claim 6, wherein the coupling mechanism is configured such that, when the drawer is moved from a position where the refill opening and the outflow opening are open towards a position where refill and outflow openings are closed, the closure member first closes the refill opening and only then the stop member closes the outflow opening.

8. The refill mechanism according to claim 6, wherein the fixed member of the toner bottle cap is held stationary in the refill adapter and the drawer is adapted to move the slide member relative to the refill adapter.

9. The refill mechanism according to claim 6, wherein the slide member is held stationary relative to the refill adapter and the drawer is configured to move the fixed member and the toner bottle relative to the refill adapter.

10. The refill mechanism according to claim 4, wherein the wall part defining the outflow opening is funnel-shaped such that, at least when the slide member is in the open position while the closure member is in the closed position, an edge portion of the outflow opening engages a seal plate on a flat top surface of the closure member.

11. The refill mechanism according to claim 10, wherein the wall part defining the outflow opening has an elasticity sufficient to bias the edge portion of the outflow opening against the seal plate.

* * * * *